US005567018A

United States Patent [19]

Hart

[11] Patent Number: 5,567,018

[45] Date of Patent: Oct. 22, 1996

[54] CONTINUOUS MINING LINEAR ADVANCE SYSTEM

[75] Inventor: Wm. Mark Hart, Littleton, Colo.

[73] Assignee: Cyprus Amax Minerals Company, Englewood, Colo.

[21] Appl. No.: 423,382

[22] Filed: Apr. 17, 1995

[51] Int. Cl.[6] ..... E21C 41/04

[52] U.S. Cl. ..... 299/11; 405/291; 405/299

[58] Field of Search ..... 299/11, 33; 405/258, 405/291, 299, 302.1

[56] References Cited

U.S. PATENT DOCUMENTS

| | | | |
|---|---|---|---|
| 4,007,966 | 2/1977 | Wenneborg . | |
| 4,019,327 | 4/1977 | Kempster . | |
| 4,030,752 | 6/1977 | Simpson | 299/11 |
| 4,131,317 | 12/1978 | Jamison et al. . | |
| 4,199,193 | 4/1980 | Damron et al. . | |
| 4,260,195 | 4/1981 | Hart . | |
| 4,332,512 | 6/1982 | Heintzmann et al. . | |
| 4,378,132 | 3/1983 | Spies et al. . | |

*Primary Examiner*—William P. Neuder
*Attorney, Agent, or Firm*—Klaas, Law, O'Meara & Malkin, P.C.

[57] ABSTRACT

A continuous mining linear advance system comprises a dual action drum cutter for removing coal from a face of the entry. The dual action drum cutter removes the coal from the face by shearing across the face in a direction transverse to the direction of advance and by cutting directly into the face in the direction of the advance. A conveyor system operatively associated with the dual action drum cutter carries away coal removed from the face of the entry in a continuous, non-interrupted manner. A number of self advancing roof supports positioned adjacent the dual action drum cutter support the roof in the immediate vicinity of the face. Roof bolting devices positioned behind the self advancing roof supports install roof bolts, and a pillar casting system positioned behind the roof bolting devices constructs a series of pillars which provide long term roof support. Each pillar is constructed from a quick-setting, concrete-like material and extends between the floor and the roof and is positioned about midway between the two opposed ribs of the entry. Isolation curtains positioned between consecutive pillars prevent air flowing down the intake side of the entry from short circuiting to the return side of the entry.

17 Claims, 8 Drawing Sheets

CONTINUOUS MINING LINEAR ADVANCE SYSTEM

BACKGROUND

The present invention relates to underground mining in general and more specifically to a system and method for developing gateroad entries in a longwall mining system.

Underground mining of a coal body is usually accomplished by cutting or driving a plurality of entries into a coal seam to divide it into various discrete panels. The sizes and configurations of the various discrete panels are made in accordance with a mine development plan that takes into account many factors, including, for example, the overall shape and configuration of the coal seam, ventilation, roof control, haulage, and escapeway requirements, as well as considerations relating to maximum resource recovery. Additional considerations may take into account various mine services such as power, water, and drainage. Once the sizes and configurations of the various panels have been determined, a plurality of gateroad entries are then driven into the coal seam to define the panels. The coal in the panels may then be removed by any of a number of various mining systems, such as continuous or longwall. The particular mining system that is used to extract the coal from the panels also depends on a variety of factors, such as, for example, the characteristics of the coal seam and surrounding strata, as well as on surface effects, such as the amount of allowable surface subsidence and, of course, overall costs.

In the continuous mining system, a continuous mining machine or "continuous miner" is used to mechanically break the coal and load it for transport onto a shuttle car or a continuous haulage system. The maximum distance that the face can be advanced on a single cut with the continuous miner is limited by roof control and ventilation requirements, as well as on equipment capability. In most continuous mining systems, the foregoing considerations limit the maximum amount that the face can be advanced in a single cutting sequence to about 30 to 40 feet. Consequently, the name "continuous mining system" is somewhat of a misnomer, since the face can only be advanced by relatively short distances before having to stop to extend roof support and ventilation to the newly advanced face.

The longwall mining system differs substantially from the continuous mining system described above. While the continuous mining system is used to cut relatively small tunnels or entries into a coal seam, the longwall mining system is used to remove an extremely large block of coal, or panel, in a single, continuous operation. While the size of the panel may vary depending on the particular coal seam, most longwall panels tend to be rather large, having widths in the range of 500 to 1,000 feet and lengths of 6,000–15,000 feet or more. However, before the longwall panel can be mined, it must first be outlined within the coal seam by gateroad entry sets.

Referring now to FIG. 1, a longwall panel 14 is shown as it could be outlined from the coal seam by gateroad entry sets developed by a continuous mining system. In a typical development process, the longwall panel 14 is outlined by driving a pair of gateroad entry sets 12 into the coal seam 78. While a gateroad entry set 12 may comprise two, three, or four entries arranged in generally parallel, spaced-apart relation, a typical gateroad entry set 12 may comprise three entries, such as entries 17, 18, and 19. The roof of each gateroad entry set 12 is supported by a plurality of pillars 20 that are defined between adjacent pairs of entries 17, 18, 19, and cross-cuts or breaks 22. The parallel gateroad entry sets 12 are connected at one end by a set of mains or submains 16 and at the other end or tailgate by a set of bleeders 24. The longwall panel 14 is thus defined between the pair of gateroad entry sets 12, the mains or submains 16, and the bleeders 24. After the panel 14 is defined, the longwall mining equipment (not shown) may then be moved into position adjacent the face 26 of panel 14. A suitable continuous haulage system (also not shown) may be installed in the entry immediately adjacent the panel 14 and used to haul away the coal removed by the longwall machine. As the longwall machine traverses across the face 26 of longwall panel 14, the face 26 is advanced in the direction of arrow 28 until the entire panel 14 is removed. The type of longwall mining system just described is referred to as "retreat" longwall mining, since the panel face 26 moves in a direction back toward the mains or submains 16.

As mentioned above, the entries 17, 18, 19 and cross cuts 22 of each gateroad entry set 12 are formed by a continuous mining system. Since the maximum advance of the continuous mining system in a single cutting sequence is necessarily limited to 30 or 40 feet, the development of the gateroad entry sets 12 is a slow process, requiring several sequential cuts. Referring now to FIG. 2, a first entry 17 may be driven into the coal seam by a continuous miner 25 to a depth equal to the maximum allowable advance, typically 30–40 feet. The continuous miner 25 then must be removed and roof bolts installed and ventilation advanced to the new face. A second cut may then be initiated by maneuvering the continuous miner 25 into a position adjacent the first cut. After advancing the second cut by the maximum advance length, the continuous miner 25 is again moved and roof support and ventilation moved to the new face defined by the second cut. The process is then repeated until one side of a pillar 20 has been defined. A second entry 18 in parallel, spaced-apart relation to the first entry 17 may then be advanced in a similar manner, removing the continuous miner and providing roof support and ventilation between face advances. After driving the second entry 18 a sufficient distance to define the opposite side of the pillar 20, a cross-cut or break 22 may then be cut between the first and second entries 17, 18 to define the pillar 20. Of course, the roof of the cross cut 20 must also be supported, usually by roof bolts. Next, a third entry 19 may be advanced into the field in parallel, spaced-apart relation to the second entry 18. A cross-cut or break 22 is then cut between the second and third entries 18 and 19 to define another pillar 20. Each gateroad entry set 12 is thus developed by cutting the various entries 17, 18, 19 and cross cuts 22 in an intermittent, grid-like fashion until the gateroad entry set 12 extends into the coal seam 78 for the full length of the longwall panel 14.

As the foregoing description makes clear, the development of the entry sets 12 required to define a longwall panel 14 having a length of 6,000–15,000 feet is by no means trivial, and represents a significant amount of the total cost, time, and manpower required to mine the longwall panel 14. The intermittent and grid-like fashion in which the gateroad entry sets 12 are mined significantly increases the ratio of total drivage per foot of section advance, and it is not unusual for a continuous miner to drive 4 to 5 feet to advance the entry set 12 a single foot in a three entry system of the type shown in FIG. 1. If the length of the longwall panel 14 is to be 15,000 feet, the continuous miner used to develop the entry sets must drive 60,000 to 75,000 feet for each gateroad entry set 12.

While such slow and inefficient entry set development has heretofore been tolerated, improvements in the longwall mining process have increased longwall mining rates to the point where gateroad entry set development cannot keep pace with longwall mining rates. Indeed, the ability to drive the number of entries required to develop new longwall panels is now the rate-determining step.

Another disadvantage associated with the currently practiced gateroad entry set development process is that the pillars 20 used to support the roof of each gateroad entry set 12 cannot be later removed. The inability to remove the coal pillars decreases the overall coal extraction ratio of the operation, i.e., the ratio of coal removed to the amount of coal remaining in-situ. Obviously, such decreased extraction ratios represent decreased utilization of the mineral resource and, usually, increased cost.

Consequently, there remains a need for a gateroad entry development system that can keep pace with the ever increasing longwall mining rates, but without increasing the cost, time, or total manpower required to develop the gateroad entries. However, the increased development rates should not be made at the expense of decreasing the extraction ratio. Additional advantages could be realized if such a gateroad entry development system decreased the costs associated with ventilation and roof support.

SUMMARY OF THE INVENTION

The continuous mining linear advance system according to the present invention may comprise a dual action drum cutter for removing coal from a face of the entry. Unlike conventional continuous miners, the dual action drum cutter not only shears across the face in a direction transverse to the direction of advance, but also cuts into the face in the direction of advance. The dual action drum cutter, therefore, allows the face of the entry to be advanced quickly and efficiently. A conveyor system operatively associated with the dual action drum cutter carries away coal removed from the face of the entry in a continuous, non-interrupted manner. A number of self advancing roof supports positioned adjacent the dual action drum cutter support the roof in the immediate vicinity of the face. Roof bolting devices positioned behind the self advancing roof supports install roof bolts, and a self-advancing pillar casting system positioned behind the roof bolting devices constructs a series of pillars which provide long term roof support. Each pillar is constructed from a quick-setting, concrete-like material and extends between the floor and the roof and is positioned about midway between the two opposed ribs of the entry. Isolation devices or walls positioned between consecutive pillars prevent air flowing down the intake side of the entry from short circuiting to the return side of the entry.

The method of advancing an entry with the continuous mining linear advance system described above may comprise the following steps. First, the coal is removed from the face of the entry by the dual action drum cutter. The dislodged coal is then carried away by the conveyor system in a continuous, non-interrupted manner. Next, upward pressure is applied to the roof by the roof supports, and roof bolts are installed by the roof bolting devices. A series of pillars are then constructed behind the roof bolting devices. Each pillar extends between the floor and the roof of the entry and is positioned about midway between the two opposed ribs. Finally, air isolation is provided between the two sides of the entry defined by the plurality of pillars and air isolation devices or walls.

The dual action drum cutter removes coal from the face of the advancing entry in a repeatable process that comprises the following steps. First, a pair of rotating cutting drums on the dual action drum cutter are sumped into the face to a first depth and at a first lateral position. The drum cutter is then moved to a second lateral position along a direction that is substantially parallel to the face of the entry, the rotating cutting drums cutting into and dislodging the coal along a lower pathway as the cutter is moved to the second position. Next, the rotating drums are elevated to a raised position and then sumped into the face to a second depth. The drum cutter is then returned to the first position, the rotating cutting drums cutting into and dislodging the coal from the face along an upper pathway. The rotating cutting drums are then returned to the lowered position and the process is repeated.

BRIEF DESCRIPTION OF THE DRAWING

Illustrative and presently preferred embodiments of the invention are shown in the accompanying drawing in which.

DETAILED DESCRIPTION OF THE INVENTION

Figure 3:
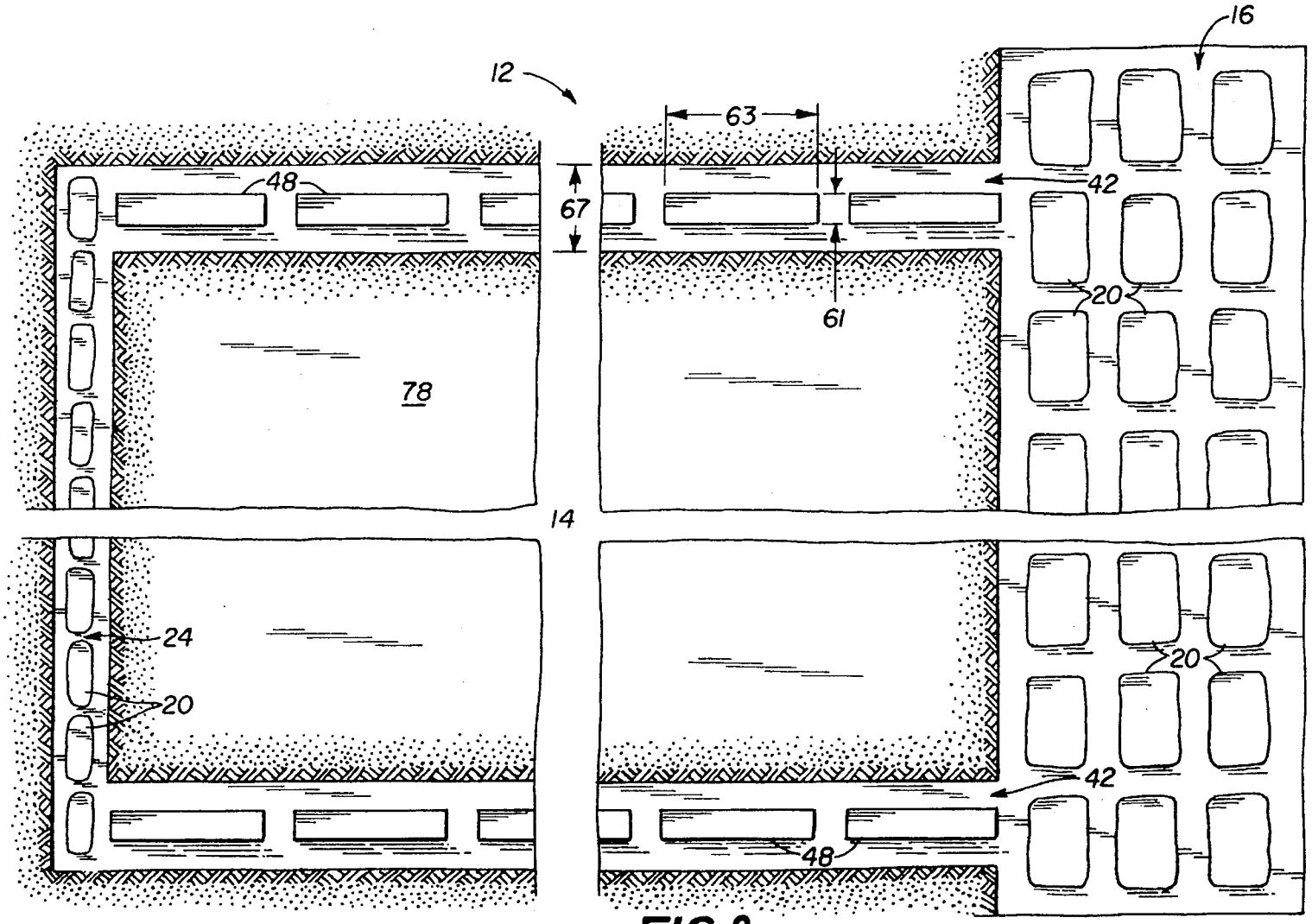
FIG. 3 is a plan view of the gateroad entry set development developed by the continuous mining linear advance system according to the present invention and showing the arrangement of the entries, bleeders, and the manufactured pillars.
Figure 4:
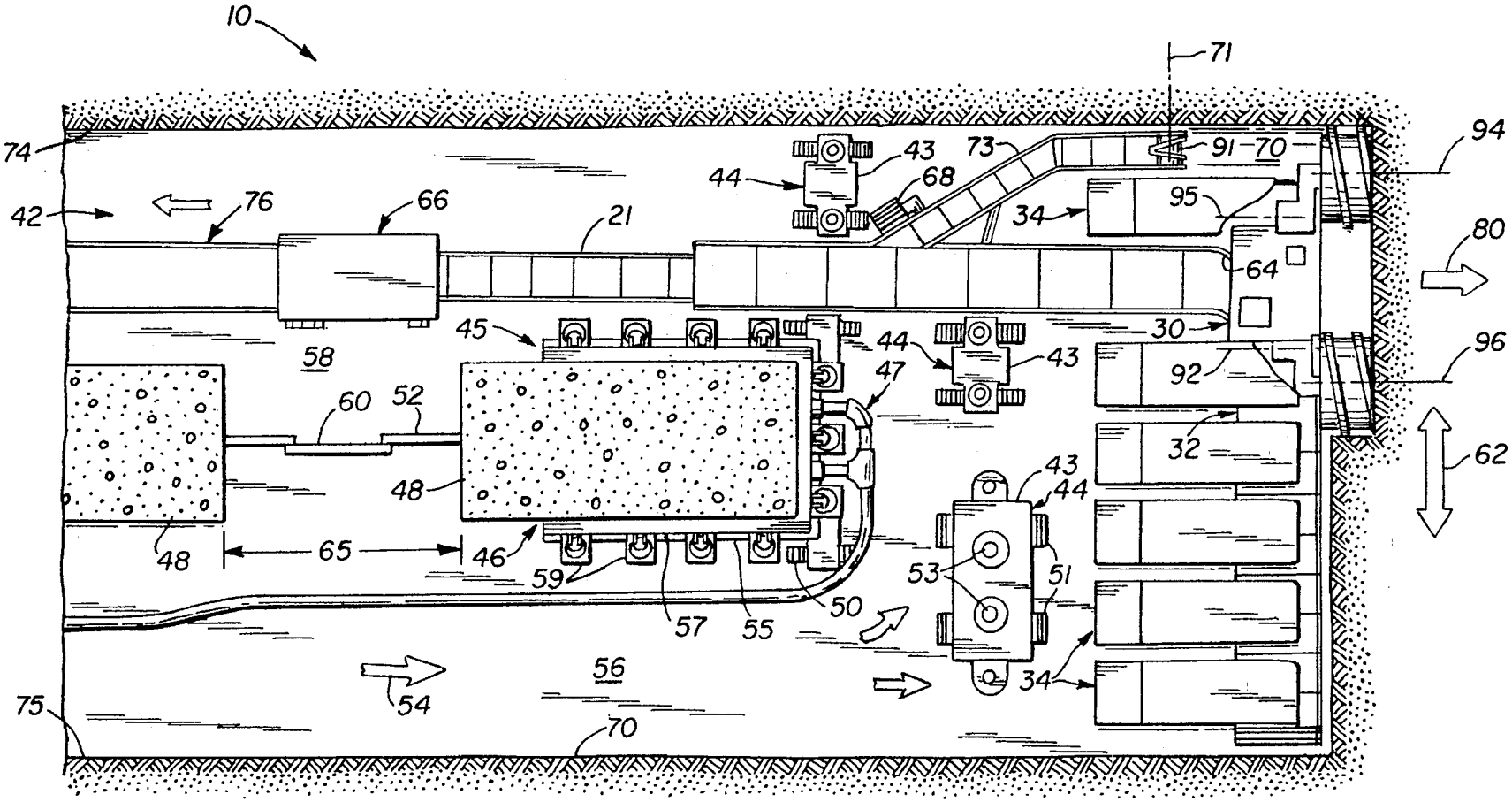
FIG. 4 is a plan view of the continuous mining linear advance system as it is being used to advance the face of an entry.
Figure 5:
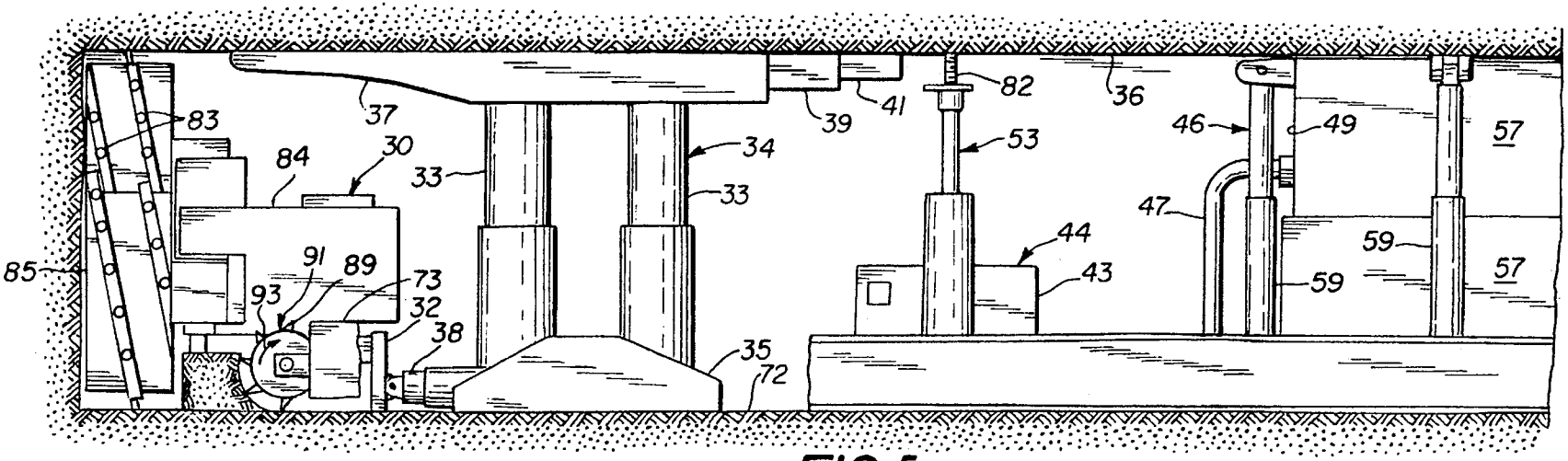
FIG. 5 is a left side view in elevation of the continuous mining linear advance system shown in FIG. 4, more clearly showing the details of the self advancing roof supports and the web cutter.
Figure 7:
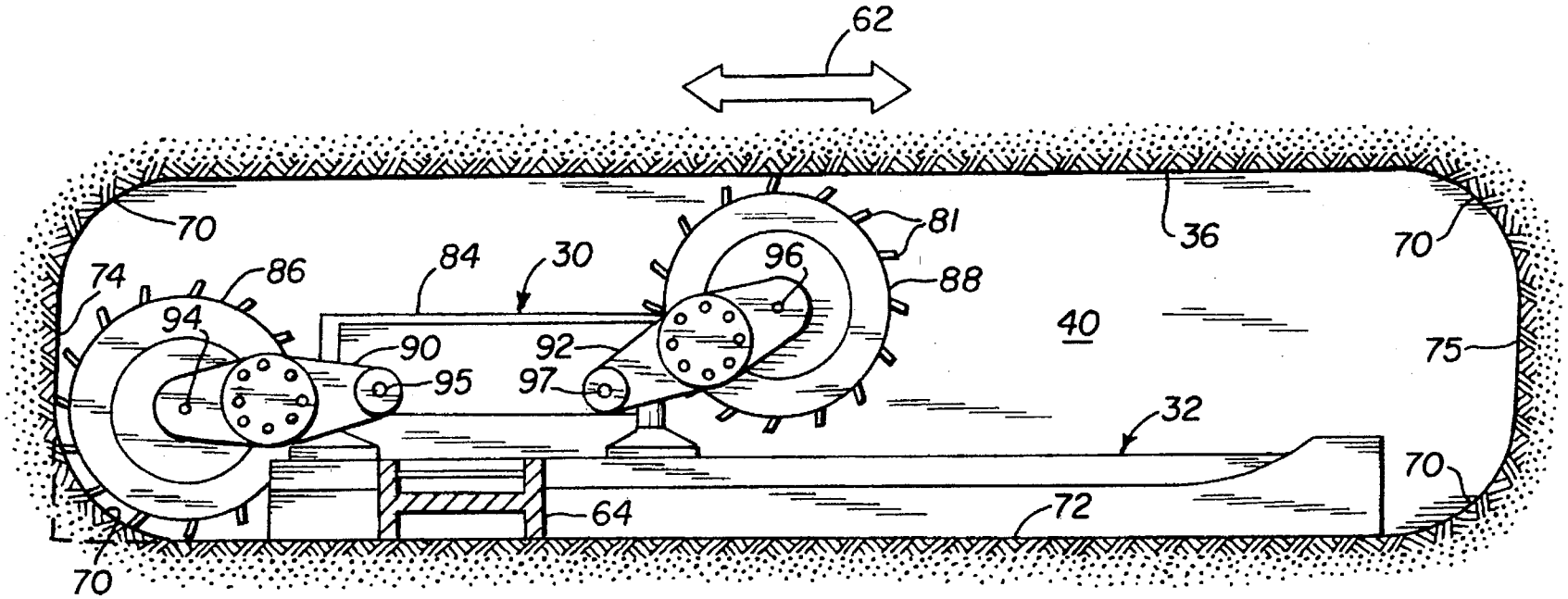
FIG. 7 is a view in elevation showing the dual action drum cutter and the advancing face defined thereby.

The continuous mining linear advance system 10 according to the present invention is best seen in FIGS. 3–5 as it could be used to cut an entry 42 into a coal seam 78 in preparation for outlining a longwall panel 14 (FIG. 3). Referring now to FIGS. 4 and 5 simultaneously, the continuous mining linear advance system 10 comprises a dual action drum cutter 30 that is slidably mounted to a face conveyor system 32 so that the dual action drum cutter 30 can be moved back and forth across a coal face 40 in the direction indicated by arrows 62. As the dual action drum cutter 30 cuts into and removes the coal from the face 40, the face 40 is advanced in the direction indicated by arrow 80. The face 40 defined by the dual action drum cutter 30 is rectangular in shape and, as it is advanced, defines a roof 36, a floor 72, and two opposed ribs 74, 75, as best seen in FIG. 7. Coal webs 70 remain at the intersections between the roof 36, floor 72, and the two opposed ribs 74, 75.

A roller curve assembly 64 connected to the face conveyor system 32 carries coal (not shown) dislodged from the advancing face 40 to a crusher assembly 66. An outby conveyor system 76 connected to crusher assembly 66 leads to a suitable discharge point (not shown) located elsewhere in the mine. A web cutter assembly 68 mounted to the roller curve assembly 64 removes the coal web 70 located between the floor 72 and sidewall or rib 74 and discharges the coal onto the roller curve assembly 64.

The roof 36 is supported in the immediate vicinity of the face 40 by a plurality of self advancing roof supports 34 that are positioned adjacent the face conveyor system 32. Each of the self advancing roof supports 34 also includes a hydraulic ram 38 (FIG. 5) connected to the face conveyor system 32 for urging the face conveyor system 32 and the dual action drum cutter 30 mounted thereon towards the advancing face 40 of the entry 42.

In one embodiment, a pair of automated roof bolting machines 44 are located immediately behind the self advancing roof supports 34. A third automated roof bolting machine 44 may be located immediately behind the conveyer 73 of web cutter assembly 68, as best seen in FIG. 4. However, other arrangements are possible, as will be described in greater detail below. The roof bolting machines 44 are used to install a plurality of roof bolts 82 into the roof 36 exposed by the advancing face 40. A pillar casting system 46 located behind the automated roof bolting machines 44 is used to construct a plurality of roof support pillars 48. The roof support pillars 48 provide long term roof support; supporting the roof 36 not only during the gateroad entry development process, but during the subsequent longwall mining process as well. In one preferred embodiment, the pillar casting system 46 includes a pair of tracks 50 and is self-advancing. Alternatively, the pillars 48 may be constructed by means of stationary forms, as will be described in greater detail below.

Isolation devices, such as walls 52, constructed between consecutive pillars 48 prevent ventilation air (indicated by arrows 54) flowing in the intake or supply side 56 of entry 42 from short circuiting to the return side 58. Some of the air isolation walls 52 may also include a mandoor 60 or an airlock door (not shown) to allow the passage of men and equipment from the supply side 56 to the return side 58. The number and spacing of the mandoors 60 or airlock doors (not shown) should to conform to applicable mine safety regulations.

The face 40 is advanced into the coal seam 78 by the dual action drum cutter 30. Referring now to FIG. 7, with occasional reference to FIGS. 4 and 5, the dual action drum cutter 30 comprises a main chassis 84 that is slidably mounted to the face conveyor system 32. A suitable drive system (not shown) connected to the chassis 84 and the face conveyor system 32 moves the cutter 30 back and forth along the face conveyor system 32 between a first position adjacent rib 74 (shown in FIG. 9(*a*)) to a second position adjacent rib 75 (shown in FIG. 9(*b*)).

Dual action drum cutter 30 also includes first and second cutting drums 86 and 88 that are mounted to respective first and second arms 90 and 92. The drums 86 and 88 are mounted for rotation about respective first and second rotation axes 94 and 96 and are driven by respective electric motors (not shown) mounted within chassis 84. The first and second arms 90, 92 are pivotally mounted to chassis 84 along respective pivot axes 95 and 97 and are connected to suitable actuators (not shown) so that the first and second drums can be pivoted between a lower position (drum 86 in FIG. 7) and an upper position (drum 88 in FIG. 7). As will be described in greater detail below, each drum 86, 88, is capable of a dual cutting action. That is, each drum is capable of cutting into the face 40 in the direction of advance (indicated by arrow 80) as well as cutting into the face 40 in the transverse directions indicated by arrows 62. The two types of cutting operations are referred to herein as "sumping" and "shearing," respectively.

The face 40 is advanced in the direction of arrow 80 in a six (6) step process that is best understood by referring to FIGS. 9(*a*)–(*d*). Initially, both drums 86 and 88 are in the lower position (FIG. 9(*a*)) and are being rotated about their respective rotation axes 94 and 96 by their respective motors (not shown). Next, the drums 86 and 88 are sumped into the face 40 by urging the face conveyor system 32 toward the face 40. This drum sump step at the first position defines the rib 74. The drive system (not shown) connected to the cutter 30 then moves or "hauls" the cutter 30 to the second position shown in FIG. 9(*b*). The second position defines the rib 75. As the cutter is moved to the second position i.e., "hauled right," the drums 86 and 88 shear across the face 40 along a lower pathway which defines the floor 72. The coal removed by the drums 86 and 88 as the cutter is "hauled right" significantly reduces the compressive stress within the upper portion of the face 40. This "de-stressing" of the upper portion of the face 40 substantially reduces the power that will be required to subsequently remove the coal from the upper portion of the face 40. Once the cutter has been moved to the second position, the first and second arms 90 and 92 are then pivoted about their respective pivot axes 95 and 97 or "ranged up" to move both drums 86 and 88 to the upper positions shown in FIG. 9(*c*). The drums 86 and 88 are then sumped into the face 40. The dual action drum cutter 30 is then moved back or "hauled left" to the first position shown in FIG. 9(*d*), adjacent rib 74; the drums 86 and 88 shearing across the face 40 along an upper pathway as the drum cutter 30 is moved back to the first position. The upper pathway defines the roof 36. The drums 86 and 88 are then pivoted or "ranged down" to the lower position (FIG. 9(*a*)). The face 40 is advanced by continually repeating the above-described process of "sumping in," "hauling right," "ranging up," "sumping in," "hauling left," and "ranging down."

During the time the dual action drum cutter 30 is advancing the face 40 in the direction of arrow 80, the coal removed from the face 40 is carried away to the crusher 66 in a continuous, non-interrupted manner by the face conveyor system 32 and the roller curve assembly 64. Crushed coal from the crusher 66 is then carried away by the outby conveyor system 76. The web cutter 68 mounted to the roller curve assembly 64 continuously cuts away the coal web 70 remaining between floor 72 and rib 74. The coal removed from the web 70 is carried by conveyor 73 and discharged onto the roller curve assembly 64, as best seen in FIGS. 4 and 5.

The advantages of the continuous mining linear advance system 10 are many. For example, a significant advantage is associated with the substantial reduction in the number of shifts required to drive an entry 42 into the coal seam 78. Whereas the conventional gateroad entry set development method using a continuous miner is a slow, intermittent process, comprising countless small advances, followed by a corresponding number of retreats to bring forward to the face roof support and ventilation, the present invention is continuous in nature, allowing the face, roof support, and ventilation to be continuously advanced in one steady push. Consequently, gateroad entry sets 42 (FIG. 3) can be driven in a fraction of the time required to drive a gateroad entry set 12 (FIG. 1) with the conventional process.

Another advantage is that the continuous mining linear advance system according to the present invention achieves a significant improvement in the advance ratio. Indeed, whereas the advance ratio associated with conventional entry set development is quite low, requiring between 4–5 feet of drivage per foot of section advance, the present invention achieves an advance ratio of 1:1. That is, each foot of drivage translates into 1 foot of section advance.

Figure 1:
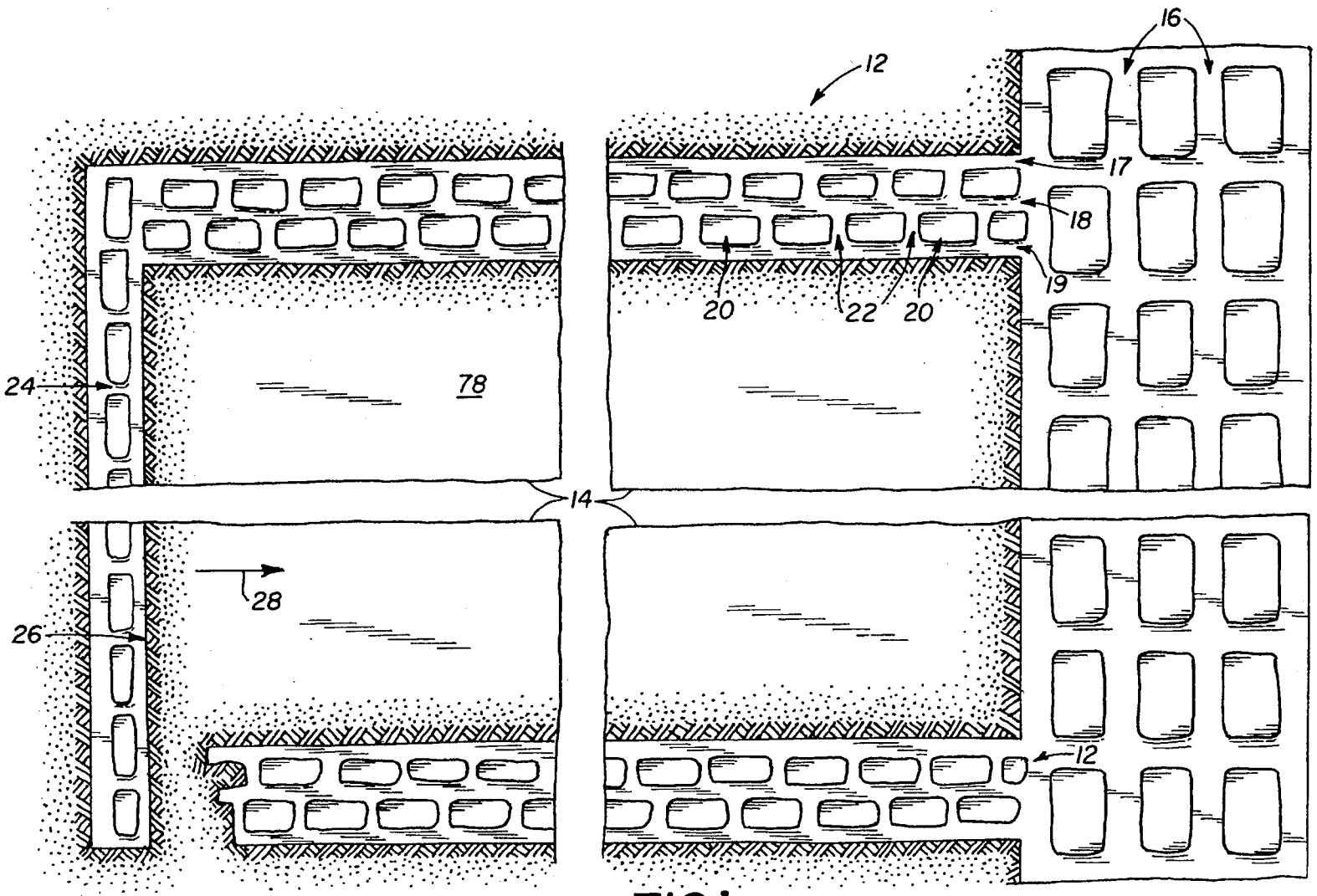
FIG. 1 is a plan view of a conventional gateroad entry set development process showing the mains or submains, bleeders, a completed gateroad entry set, and a gateroad entry set still under development.
Figure 2:
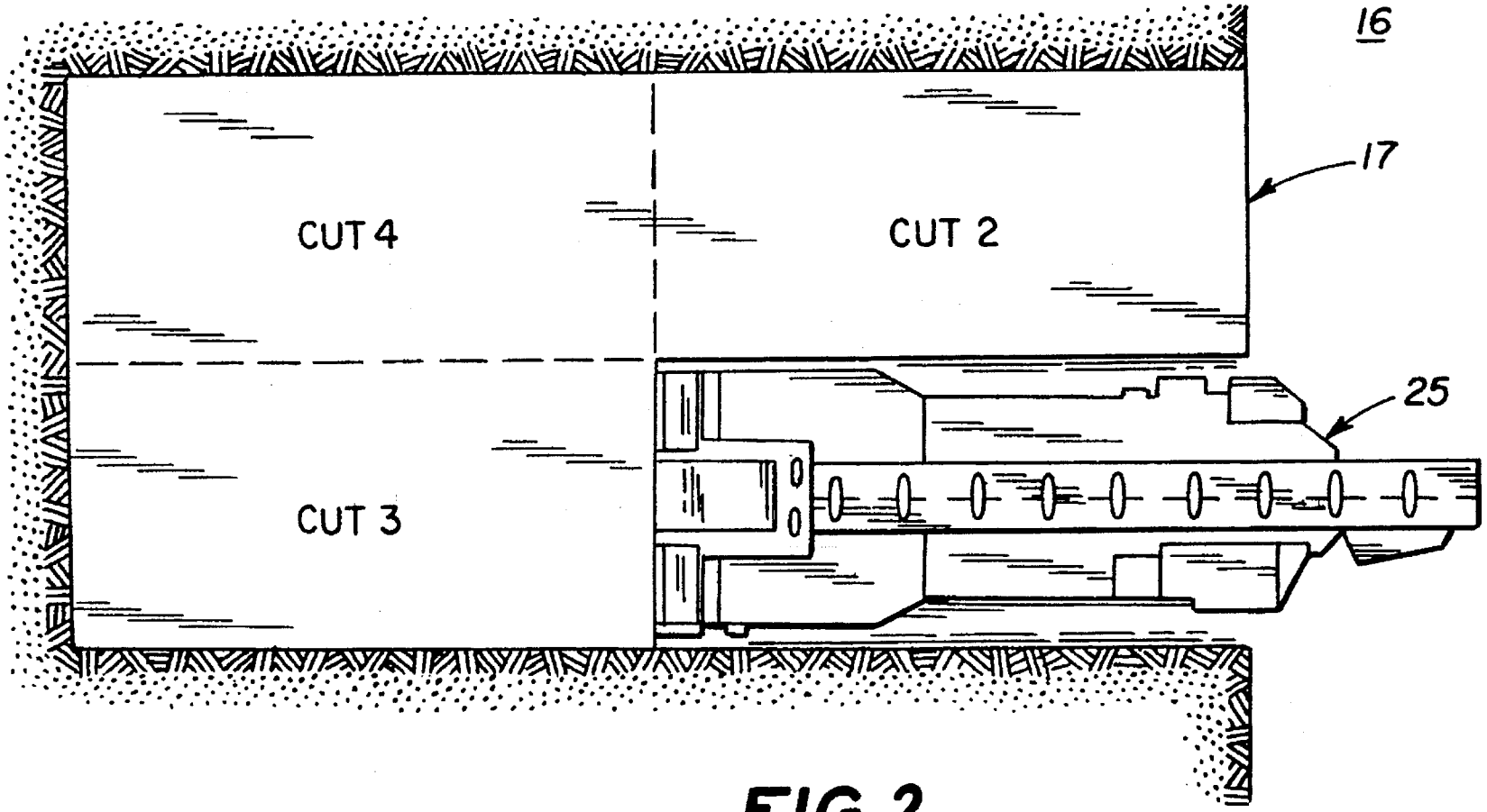
FIG. 2 is a plan view of a cutting sequence for the development of a single entry by a continuous miner.

The extraction ratio, i.e., the volume of coal extracted compared with the volume of coal in the longwall development area, is also significantly improved. In a conventional entry system, a significant volume of coal remains in-situ in the form of roof support pillars 20 (FIG. 1). These coal pillars 20 may represent 15% or more of the total volume of coal in the longwall development area. Consequently, only about 85% of the total volume of coal in the longwall development area can be extracted in a retreat longwall operation using the conventional entry set development process shown in FIG. 1. In contrast, a retreat longwall operation utilizing entries developed according to the present invention may achieve 100% coal extraction. The reduced size and volume of entry sets developed according to the present invention also reduces the costs associated with roof support and ventilation.

As was briefly described above, the continuous mining linear advance system 10 is shown and described herein as it may be used to develop a pair of entries 42, 43 to define a longwall panel 14 which may later be mined according to the well-known retreat longwall mining process. See FIG. 3. More specifically, a longwall panel 14 may be defined between a pair of entries 42, mains or submains 16, and bleeders 24. In one preferred embodiment, the mains or submains 16 and bleeders 24 are constructed by a continuous mining system and include a plurality of coal pillars 20 to provide the required roof support. Alternatively, the bleeders 24 may be developed in a manner similar to the entries 42 using the continuous mining linear advance system 10.

Both entries 42 are identical and are developed according to the continuous mining linear advance system 10 shown in FIGS. 4–7. As was briefly described above, the continuous mining linear advance system comprises a dual action drum cutter 30 for cutting away the coal from the face 40; a web cutter 68 for cutting away the coal remaining in the coal web 70 between the floor 72 and rib 74; a conveyor system for hauling away the coal removed by the drum cutter 30 and web cutter 68; as well as various roof support systems for supporting the roof of the entry.

The dual action drum cutter 30 is best seen in FIGS. 5 and 7 and comprises a chassis 84 that is slidably mounted to the face conveyor system 32. A haulage system (not shown), connected to the chassis 84 and the face conveyor system 32 moves the cutter 30 back and forth along the face conveyor system 32 between a first position adjacent rib 74 (shown in FIG. 9(*a*)) to a second position adjacent rib 75 (shown in FIG. 9(*b*)). In one preferred embodiment, the dual action drum cutter 30 is available from the Anderson Group Limited of Lanarkshire, Scotland. The haulage system may comprise a "Rhinoride" chain and sprocket drive system available from Westfalia Mining Progress, Inc., of Washington, Pa., although other haulage systems are available and could be substituted.

The dual action cutter assembly also includes first and second cutting drums 86 and 88 that are mounted to respective first and second arms 90 and 92. The drums 86 and 88 are mounted for rotation about respective first and second rotation axes 94 and 96 and are driven by respective electric motors (not shown) mounted within chassis 84. The first and second arms 90, 92 are pivotally mounted to chassis 84 along respective pivot axes 95 and 97 and are connected to suitable actuators (not shown) so that the first and second drums can be pivoted between a lower position (drum 86 in FIG. 7) and an upper position (drum 88 in FIG. 7).

Figure 8:
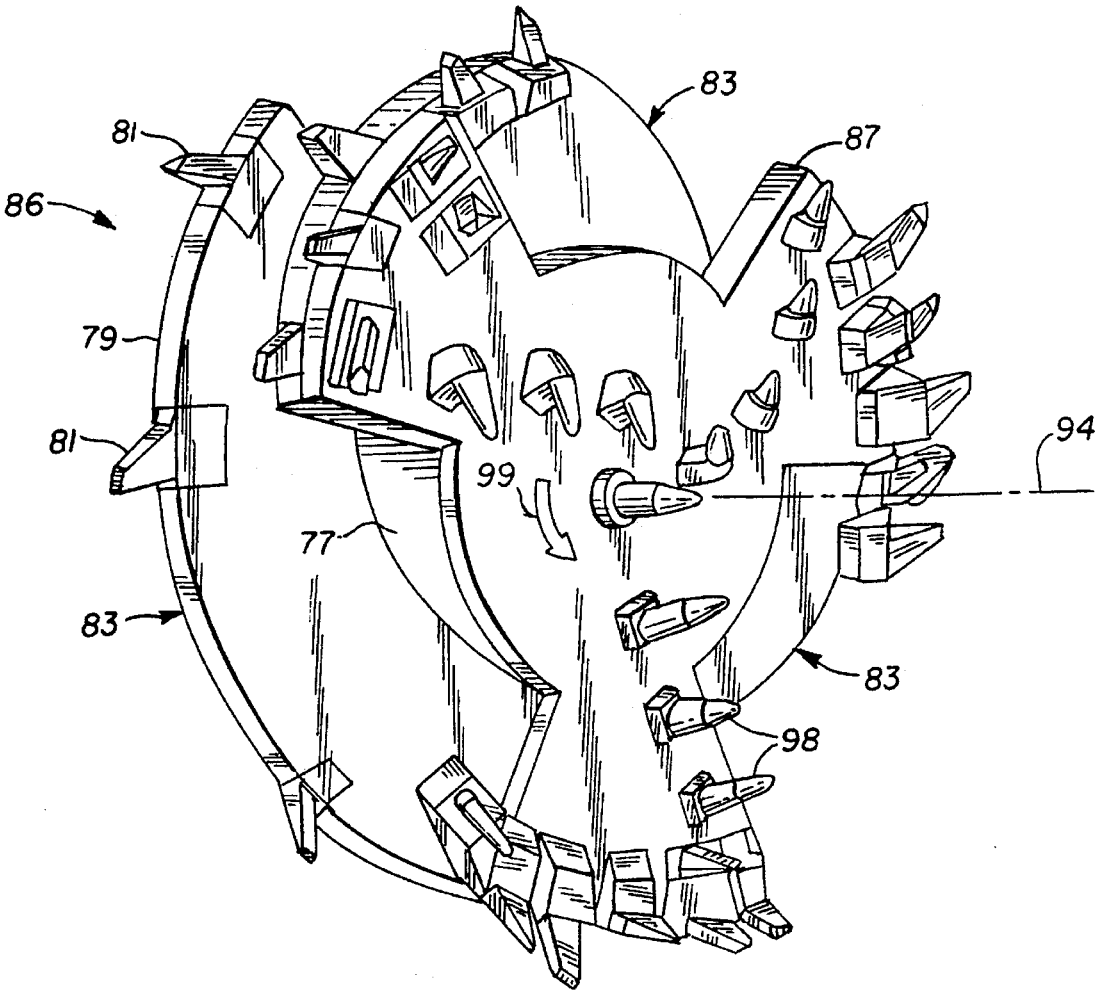
FIG. 8 is a perspective view of one of the cutting drums.
Figure 9A:
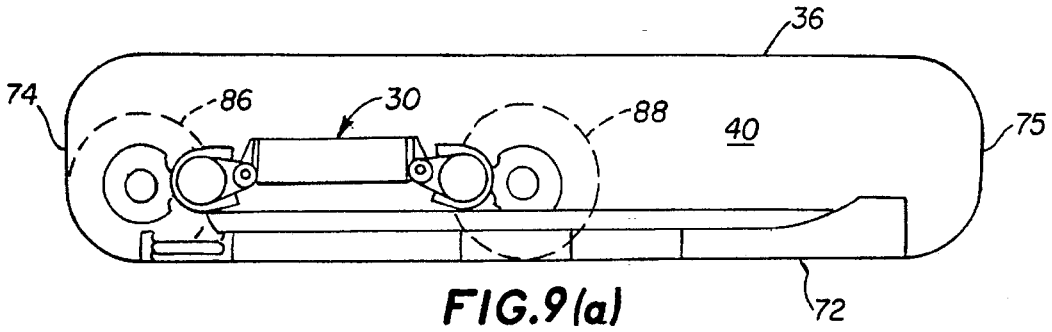
FIG. 9 (*a–d*) is a view in elevation of the various positions of the dual action drum cutter during the various steps in the face advance process.
Figure 9B:
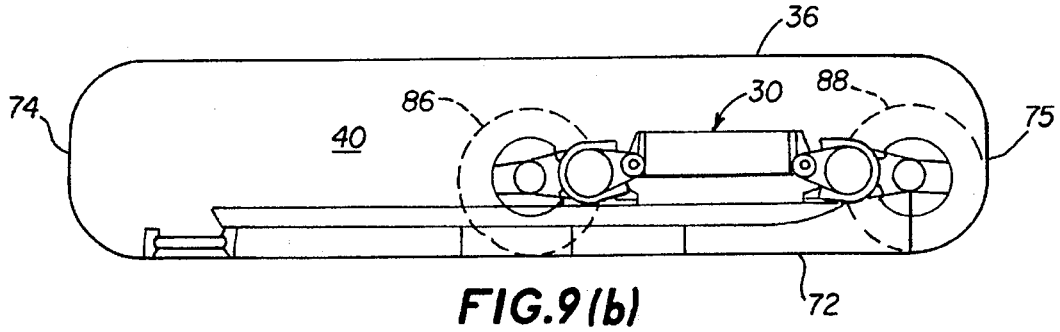
Figure 9C:
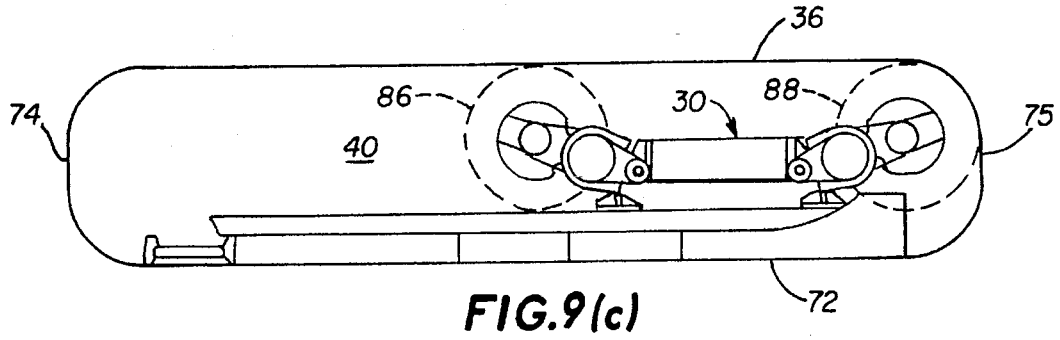
Figure 9D:
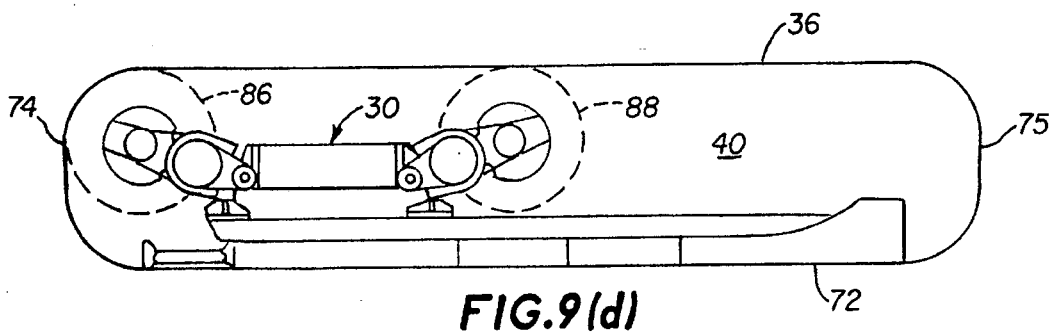

Since each cutting drum 86, 88 is identical, only the features of cutting drum 86 will be described in detail. Referring now to FIG. 8, cutting drum 86 comprises a central drum portion 79 to which is attached a front plate 87 and a plurality of spiral members 83. Each spiral member 83 includes a plurality of cutting teeth 81 arranged around its outer perimeter 79 so that the teeth 81 extend radially outward and are slightly biased in the direction of rotation, indicated by arrow 99. The front plate 87 includes a plurality of sumping teeth 98 that extend axially outward from front plate 87 and are also partially biased in the direction of rotation (arrow 99), substantially in the manner shown in FIG. 8.

The arrangement of the spirals 83, cutting teeth 81, and sumping teeth 98 allows the drum to cut effectively in two directions: Parallel to the axis of rotation 94 and transverse to the axis of rotation 94. Put in other words, each drum is capable of "sumping into" the face 40 in the direction of advance 80 (FIG. 4) as well as "shearing across" the face 40 in the directions indicated by arrows 62. Cutting drums of the type described above are available from the Anderson Group Limited of Lanarkshire, Scotland.

The face 40 is advanced in the direction of arrow 80 in a six (6) step process that is best understood by referring to FIGS. 9(*a*)–(*d*). Initially, both drums 86 and 88 are in the lowered position (FIG. 9(*a*)) and are being rotated about their respective rotation axes 94 and 96 by their respective motors (not shown). During the first step, the drums 86 and 88 are sumped into the face 40. The step of sumping into the face 40 is accomplished by extending the hydraulic rams 38 on the self advancing roof supports 34 to push the face conveyor system 32 and the cutter 30 mounted thereon into the face 40. In one preferred embodiment, the dual action drum cutter 30 is sumped into the coal seam to a depth of about 18 inches.

After the drums 86, 88 have been sumped into the face, the haulage system (not shown) connected to the cutter 30 then moves or "hauls" the cutter 30 to the second position shown in FIG. 8(*b*), adjacent rib 75. As the cutter 30 is hauled right, the drums 86 and 88 shear across the face 40 along a lower pathway, dislodge the coal, move it away from the face 40, whereupon it falls onto the surface of the face conveyor 32. Once the cutter has been moved to the second position, the first and second arms 90 and 92 are then pivoted about their respective pivot axes 95 and 97 or "ranged up" to move both drums 86 and 88 to the upper positions shown in FIG. 9(c). The drums 86, 88 cut away coal from the face 40 as they are ranged upward.

After the drums 86, 88 have been "ranged up" into their upper positions, the drums 86 and 88 are again sumped into the face 40 a distance of about 18 inches by extending the hydraulic rams 38 connected between the face conveyor 32 and the self advancing roof supports 34 by an equal amount. Next, the haulage system moves the dual action drum cutter 30 back to the first position shown in FIG. 9(*d*), adjacent rib 74. As the cutter 30 is hauled left, the drums 86 and 88 shear across the face 40 along an upper pathway, removing coal along the way. After being returned to the first position, the arms 90, 92 are then pivoted or "ranged down" to move the drums 86 and 88 back to their lowered position (FIG. 9(*a*)). The face 40 is advanced by continually repeating the above-described process of "sumping in," "hauling right," "ranging up," "sumping in," "hauling left," and "ranging down."

As was mentioned above, removing the coal from the lower pathway significantly reduces the compressive stress contained within the coal that remains along the upper pathway. This "de-stressing" of the coal along the upper pathway substantially reduces the power required to subsequently remove the coal along the upper pathway, thus allowing the drums 86 and 88 to be sumped in into the face 40 an additional 18 inches or so before "hauling left."

The conveyor system comprises a face conveyor 32, a roller curve assembly 64, and an outby conveyor 76, and carries away coal (not shown) removed from the face 40 by the dual action drum cutter 30. In one preferred embodiment, the face conveyor 32 and roller curve assembly 64 comprise a single conveyor system available from Westfalia Mining Progress, Inc., of Washington, Pa. as the model PF-4 Curved Conveyor, although other conveyors could be used. Since the continuous mining linear advance system 10 is capable of continuously advancing the face 40, the outby conveyor system 76 should be of the type that are extendable during operation, so that the coal removed by the dual action drum cutter 30 can be carried away in an uninterrupted manner. In one preferred embodiment, the outby conveyor 76 comprises an "Extendaveyor" conveyor available from Continental Conveyor and Equipment Company of Winfield, Ala.

Figure 6:
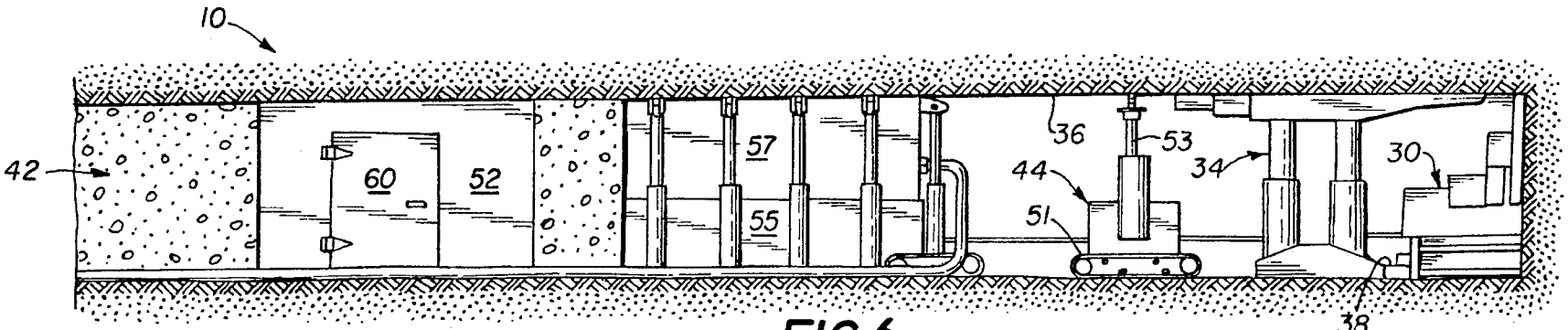
FIG. 6 is a right side view in elevation of the continuous mining linear advance system shown in FIG. 4.

As was described above, the dual action drum cutter 30 and face conveyor assembly 32 are advanced toward the face 40 by the self advancing roof supports 34. Referring now to FIGS. 5 and 6, each self advancing roof support 34 includes a base 35, a canopy 37, and a pair of hydraulic jacks 33. Canopy 37 also includes support extensions 39 and 41 that can be extended and retracted as necessary to provide roof support all the way back to the automated roof bolting devices 44. The pair of hydraulic jacks 33 connected between the base 35 and canopy 37 urge the base 35 and canopy 37 against the floor 72 and roof 36. A hydraulic ram 38 connected between the base 35 and face conveyor assembly 32 is used to urge the face conveyor assembly 32 toward the face 40 during the "sump-in mode" described above. However, the hydraulic rams 38 are also used to pull the support 34 toward the face conveyor assembly 32 during an "advance mode."

Essentially, the advance mode may occur when it is not necessary to sump the drums 86, 88 into the face 40, such as, for example, during the "haul right" or "haul left" steps described above. The first step in the advance mode is to retract the roof support jacks 33 to relieve the upward pressure on the canopy 37. The ram 38 is then retracted to pull the support 34 toward the face conveyor 32. After the support 34 has been pulled toward the face conveyor 32, the roof support jacks 33 are again extended to provide upward pressure on the roof 36. In one preferred embodiment, every other roof support 34 may be advanced at the same time. Alternatively, the supports 34 may be advanced one-by-one.

The web cutter assembly 68 is best seen in FIGS. 4 and 5 and comprises a web cutting drum 91 mounted to one end of a conveyor 73. The other end of the conveyor 73 is mounted to the roller curve assembly 64 so that coal (not shown) carried by conveyor 73 is discharged onto the roller curve assembly 64. During operation, a motor or hydraulic drive (not shown) turns web cutting drum 91 about axis 71 in the direction indicated by arrow 93. The teeth 89 mounted to the drum 91 cut into the coal web 70 and discharge the dislodged coal (not shown) onto the conveyor 73. In one preferred embodiment, the web cutter assembly 68 is fixedly mounted to the roller curve assembly 64 so that it is advanced along with the roller curve assembly. Alternatively, the web cutter assembly 68 may be self advancing. A web cutter assembly of the type shown and described herein is available from Westfalia Mining Progress, Inc., of Washington, Pa.

The mechanized and automated roof bolting machines 44 are best seen in FIGS. 4–6 and may comprise a chassis 43 to which are mounted one or more boom assemblies 53 that are adapted to bore a hole into the roof 36 and insert a roof bolt assembly 82. Each roof bolting apparatus 44 may be mounted on tracks 51 to allow easy movement as the face 40 advances. Roof bolting machines of the type shown and described herein are available from the J. H. Fletcher & Company of Huntington, W. Va. and Tamrock EJC USA, Inc., of Atlanta, Ga. Such roof bolting machines may also be available from other roof bolting machine manufacturers.

Still referring to FIGS. 4–6, the pillar casting system 46 may comprise a slip form assembly 45 having a lower panel 55 and an upper panel 57 mounted so that the upper panel 57 can be extended and retracted into the lower panel 55 by means of a plurality of hydraulic jacks 59. The slip form assembly 45 may thus be adjusted to conform to a wide range of roof heights. In one preferred embodiment, the slip form assembly 45 is mounted to a pair of tracks 50 and is self-advancing. Alternatively, the front end 49 of slip form assembly 45 may be connected to the self-advancing chocks 34 by a chain or cable (not shown), so that it is advanced along with the chocks 34. The front end 49 of slip form assembly 45 is adapted to receive a material supply hose assembly 47 which is in turn connected to a suitable material supply and delivery system (not shown) located elsewhere in the mine. The material supply and delivery system is used to deliver the pillar material in a liquid or slurry form to the slip form 45.

The material used for the pillars 48 should be a quick setting concrete or concrete-like material having a compressive strength commensurate with providing adequate roof support with a reasonable pillar size. While a wide variety of quick setting concrete or concrete-like materials may be used for the pillars 48, it is preferred that the pillar material comprise Tech Seal, available from the Celtite Division of Fosroc, Inc. of Grand Junction, Colo., which has a compressive strength in the range of about 500 to 2,200 psi. Tech Seal sets-up very quickly, in the range of a few minutes at most, and achieves full compressive strength within several days. If it is not possible to use such a quick setting material for the pillars, it may be desirable to replace the slip form assembly 45 with a more conventional stationary form (not shown), which will more easily accommodate a slower setting material, such as concrete.

Regardless of the particular type of material that used for the pillars 48, it must have sufficient compressive strength to support the expected roof loads at the time they are expected to be imposed. For example, during the development of the gateroad entry sets, the pillars 48 must absorb the expected tributary stresses or roof loads, which are typically in the range of about 400 to 800 psi. However, after the gateroad entries have been developed and the longwall mining process initiated, the pillars 48 must also absorb the expected forward abutment stresses or roof loads, which are typically in the range of about 140 to 280 psi. Side abutment stresses or roof loads in the range of about 100 to 200 psi may also be imposed by adjacent gob. Of course, the magnitude of the tributary, forward and side abutment stresses may vary from the ranges identified above depending on the amount and stratigraphy of the overburden. Consequently, the material used for the pillars 48 must have developed sufficient strength to absorb the expected tributary, forward, and side abutment stresses or loads by the time they are expected to occur.

While the size of the pillars 48 is dependent on the geology of the particular mine, in one preferred embodiment having an entry width 67 of 40 feet (FIG. 3), each pillar 48 has a width 61 of about 10 feet, and a length 63 of about 85 feet. Therefore, the spacing 65 (FIG. 4) between adjacent pillars is about 15 feet.

The entry 42 is driven into the coal seam 78 in a continuous manner as follows. The dual action drum cutter 30 travels back and forth along the face conveyor system 32 in the direction of arrow 62, continuously advancing the face 40 into the coal seam 78 in the direction indicated by arrow 80. A suitable guide and alignment system using microprocessing technology may be used to guide and align the face 40, and the entry 42 created thereby, in the proper direction. As the face 40 advances, so do the self advancing roof supports 34, which provide upward pressure to the roof 36 to prevent it from caving-in on the dual action drum cutter 30 and face conveyor system 32. The automated roof bolting machines 44 follow behind the self advancing roof supports 34 and install a plurality of roof bolts 82 at predetermined spacings commensurate with an approved roof support plan. The pillar casting system 46 trammed behind the self advancing supports 34 is used to continuously cast the pillars 48 from the Tech Seal quick setting material. After being injected into the front end 49 of slip form assembly 45, the Tech Seal sets-up, developing sufficient compressive strength to support the roof 36 by the time it is exposed by the advancing slip form assembly 45. As each pillar 48 is being cast, an air isolation wall 52 is constructed between the previously completed pillar and the pillar currently being cast. The pillars 48 and air isolation walls 52 divide the entry 42 into an air supply side 56 and an air return side 58, thus allowing ventilation air 54 flowing down the supply side 56 to ventilate the face 40 and return through the return side 58. Some of the air isolation walls 52 may also include mandoors 60 or airlock doors (not shown) spaced at periodic intervals as may be required by applicable mine safety regulations.

It is contemplated that the inventive concepts herein described may be variously otherwise embodied and it is intended that the appended claims be construed to include alternative embodiments of the invention except insofar as limited by the prior art.

What is claimed is:

1. A method of developing an entry in a coal body, comprising the steps of:

removing coal from a face of the entry, the face exposing a roof, a floor, and two opposed ribs as it is advanced into the coal body;

carrying away coal removed from the face of the entry in a continuous, non-interrupted manner;

removing coal from a web remaining between the floor and one of the opposed ribs;

carrying away coal removed from the web in a continuous, non-interrupted manner;

applying an upward pressure to the roof;

installing a plurality of roof bolts into the roof;

constructing a plurality of pillars extending substantially between the floor and the roof and positioned about midway between the two opposed ribs, the plurality of pillars dividing the entry into two sides; and providing air isolation between the two sides of the entry defined by the plurality of pillars.

2. The method of claim 1, wherein the step of removing coal from a face of the entry comprises the steps of:

sumping into the face to a first depth at a first lateral position with a dual action drum cutter having a first cutting drum mounted for rotation about a first axis and a second cutting drum mounted for rotation about a second axis, said first and second axes being in substantially parallel, spaced-apart relation and substantially perpendicular to the face, said first and second cutting drums also being adapted to cut into the coal body in a sumping direction substantially parallel to said first and second axes and in a shearing direction substantially transverse to said first and second axes;

moving the dual action drum cutter to a second lateral position along a direction that is substantially parallel to the face and perpendicular to the two opposed ribs, the first and second drums cutting into and dislodging the coal along a lower pathway as the dual action drum cutter is moved to the second lateral position;

elevating the first and second cutting drums to a raised position;

sumping into the face to a second depth;

returning the dual action drum cutter to the first lateral position, the first and second drums cutting into and dislodging the coal along an upper pathway as the dual action drum cutter is returned to the first lateral position; and lowering the first and second cutting drums to a lowered position.

3. Linear advance apparatus for developing an entry into a coal body, comprising:

a dual action drum cutter for removing coal from a face of the entry, the face exposing a roof, a floor, and two opposed ribs as the face is advanced;

a conveyor operatively associated with said dual action drum cutter for carrying away coal removed from the face of the entry in a continuous, non-interrupted manner;

self advancing roof support apparatus positioned adjacent said dual action drum cutter for providing an upward pressure to the roof;

roof bolting apparatus positioned adjacent said roof support apparatus for inserting a plurality of roof bolts into the roof;

pillar casting apparatus positioned behind said roof bolting apparatus for constructing a plurality of pillars, each of the plurality of pillars extending substantially between the floor and the roof and positioned about midway between the two opposed ribs, the plurality of pillars dividing the entry into two sides; and a plurality of isolation devices positioned between consecutive pillars for providing air isolation between the two sides of the entry.

4. The linear advance apparatus of claim 3, further comprising web cutter apparatus operatively associated with said conveyor for removing a web of coal remaining between the floor and one of the two opposed ribs and discharging the coal onto said conveyor.

5. The linear advance apparatus of claim 4, wherein said dual action drum cutter comprises a first cutting drum mounted for rotation about a first axis and a second cutting drum mounted for rotation about a second axis, said first and second axes being in substantially parallel, spaced-apart relation and substantially perpendicular to the face, said first and second cutting drums also being adapted to cut into the coal body in a sumping direction substantially parallel to said first and second axes and in a shearing direction substantially transverse to said first and second axes.

6. The linear advance apparatus of claim 5, wherein said web cutting apparatus comprises:

a web cutting drum mounted for rotation about a third axis, said third axis being substantially perpendicular to one of the opposed ribs and substantially parallel to the advancing face and to the floor, said web cutting drum being adapted to cut into the web of coal in a shearing direction substantially transverse to said third axis; and a web conveyor mounted to said web cutting drum for receiving coal dislodged by said web cutting drum and discharging the coal onto said conveyor.

7. The linear advance apparatus of claim 6, wherein said web cutting drum and said web conveyor are advanced along with said dual action drum cutter.

8. Linear advance apparatus for developing an entry into a coal body, comprising:

a dual action drum cutter for removing coal from a face of the entry, the face exposing a roof, a floor, and two opposed ribs as the face is advanced, wherein said dual action drum cutter includes a first cutting drum mounted for rotation about a first axis and a second cutting drum mounted for rotation about a second axis, said first and second axes being in substantially parallel, spaced-apart relation and substantially perpendicular to the face, said first and second cutting drums also being adapted to cut into the coal body in a sumping direction substantially parallel to said first and second axes and in a shearing direction substantially transverse to said first and second axes;

a conveyor operatively associated with said dual action drum cutter for carrying away coal removed from the face of the entry in a continuous, non-interrupted manner, wherein said conveyor includes a face conveyor, a roller curve conveyor, and an outby conveyor, said face conveyor being adapted to receive said dual action drum cutter, said roller curve conveyor being operatively associated with said face conveyor, wherein coal carried by said face conveyor is transferred to said roller conveyor in a continuous, non-interrupted manner, and wherein said outby conveyor is operatively associated with said roller curve conveyor, wherein coal carried by said roller curve conveyor is transferred to said outby conveyor in a continuous, non-interrupted manner;

web cutter apparatus operatively associated with said conveyor for removing a web of coal remaining between the floor and one of the two opposed ribs and discharging the coal onto said conveyor, wherein said web cutting apparatus includes a web cutting drum mounted for rotation about a third axis, said third axis being substantially perpendicular to one of the opposed ribs and substantially parallel to the advancing face and to the floor, said web cutting drum being adapted to cut into the web of coal in a shearing direction substantially transverse to said third axis, and a web conveyor mounted to said web cutting drum for receiving coal dislodged by said web cutting drum and discharging the coal onto said conveyor, wherein said web cutting drum and said web conveyor are advanced along with said dual action drum cutter;

self advancing roof support apparatus positioned adjacent said dual action drum cutter for providing an upward pressure to the roof;

roof bolting apparatus positioned adjacent said roof support apparatus for inserting a plurality of roof bolts into the roof;

pillar casting apparatus positioned behind said roof bolting apparatus for constructing a plurality of pillars, each of the plurality of pillars extending substantially between the floor and the roof and positioned about midway between the two opposed ribs, the plurality of pillars dividing the entry into two sides; and a plurality of isolation devices positioned between consecutive pillars for providing air isolation between the two sides of the entry.

9. The linear advance apparatus of claim 8, further comprising a coal crusher positioned between said roller curve conveyor and said outby conveyor for crushing coal collected from said roller curve conveyor and discharging crushed coal onto said outby conveyor.

10. The linear advance apparatus of claim 9, including ram apparatus connected between said dual action drum cutter and said face conveyor, said ram apparatus being adapted to urge said dual action drum cutter toward said face during a sump-in mode, and being adapted to move said roof support apparatus toward said face conveyor during a roof support apparatus advance mode.

11. The linear advance apparatus of claim 10, including haulage means connected to said conveyor system and to said dual action drum cutter for moving said dual action drum cutter between first and second lateral positions along a direction substantially parallel to said face and perpendicular to the two opposed ribs.

12. Linear advance apparatus for developing an entry into a coal body, comprising:

a dual action drum cutter for removing coal from a face of the entry, the face exposing a roof, a floor, and two opposed ribs as the face is advanced;

a conveyor operatively associated with said dual action drum cutter for carrying away coal removed from the face of the entry in a continuous, non-interrupted manner;

self advancing roof support apparatus positioned adjacent said dual action drum cutter for providing an upward pressure to the roof;

roof bolting apparatus positioned adjacent said roof support apparatus for inserting a plurality of roof bolts into the roof;

pillar casting apparatus positioned behind said roof bolting apparatus for constructing a plurality of pillars, each of the plurality of pillars extending substantially between the floor and the roof and positioned about midway between the two opposed ribs, the plurality of pillars dividing the entry into two sides, wherein said pillar casting apparatus comprises a self-advancing slip form assembly comprising self-advancing track means, a lower panel, and an upper panel, each of said lower and upper panels having a front panel portion and two side panel portions, the side panel portions being in spaced-apart relation and substantially perpendicular the front panel portion, the lower and upper panels being sized relative to one another such that said upper and lower panel portions are slidably engaged, said slip form assembly also including jacking means connected between said lower panel and said upper panel for raising and lowering said upper panel with respect to said lower panel, said slip form assembly also being adapted to receive a flowable pillar casting material; and a plurality of isolation devices positioned between consecutive pillars for providing air isolation between the two sides of the entry.

13. The linear advance apparatus of claim 12, wherein said flowable pillar casting material comprises quick setting concrete.

14. The linear advance apparatus of claim 12, wherein said flowable pillar casting material comprises Tech Seal.

15. A method of developing an entry in a coal body, comprising the steps of:

removing coal from a face of the entry, the face exposing a roof, a floor, and two opposed ribs as it is advanced into the coal body, by sumping into the face to a first depth at a first lateral position with a dual action drum cutter having a first cutting drum mounted for rotation about a first axis and a second cutting drum mounted for rotation about a second axis, said first and second axes being in substantially parallel, spaced-apart relation and substantially perpendicular to the face, said first and second cutting drums also being adapted to cut into the coal body in a sumping direction substantially parallel to said first and second axes and in a shearing direction substantially transverse to said first and second axes;

moving the dual action drum cutter to a second lateral position along a direction that is substantially parallel to the face and perpendicular to the two opposed ribs, the first and second drums cutting into and dislodging the coal along a lower pathway as the dual action drum cutter is moved to the second lateral position;

elevating the first and second cutting drums to a raised position;

sumping into the face to a second depth;

returning the dual action drum cutter to the first lateral position, the first and second drums cutting into and dislodging the coal along an upper pathway as the dual action drum cutter is returned to the first lateral position;

lowering the first and second cutting drums to a lowered position;

carrying away coal removed from the face of the entry in a continuous, non-interrupted manner;

removing coal from a web remaining between the floor and one of the opposed ribs;

carrying away coal removed from the web in a continuous, non-interrupted manner;

applying an upward pressure to the roof;

installing a plurality of roof bolts into the roof;

constructing a plurality of pillars extending substantially between the floor and the roof and positioned about midway between the two opposed ribs, the plurality of pillars dividing the entry into two sides; and providing air isolation between the two sides of the entry defined by the plurality of pillars.

16. Linear advance apparatus for developing an entry into a coal body, comprising:

a dual action drum cutter for removing coal from a face of the entry, the face exposing a roof, a floor, and two opposed ribs as the face is advanced, said dual action drum cutter comprising a first cutting drum mounted for rotation about a first axis and a second cutting drum mounted for rotation about a second axis, said first and second axes being in substantially parallel, spaced-apart relation and substantially perpendicular to the face, said first and second cutting drums also being adapted to cut into the coal body in a sumping direction substantially parallel to said first and second axes and in a shearing direction substantially transverse to said first and second axes;

a conveyor operatively associated with said dual action drum cutter for carrying away coal removed from the face of the entry in a continuous, non-interrupted manner;

web cutter apparatus operatively associated with said conveyor for removing a web of coal remaining between the floor and one of the two opposed ribs and discharging the coal onto said conveyor;

self advancing roof support apparatus positioned adjacent said dual action drum cutter for providing an upward pressure to the roof;

roof bolting apparatus positioned adjacent said roof support apparatus for inserting a plurality of roof bolts into the roof;

pillar casting apparatus positioned behind said roof bolting apparatus for constructing a plurality of pillars, each of the plurality of pillars extending substantially between the floor and the roof and positioned about midway between the two opposed ribs, the plurality of pillars dividing the entry into two sides; and a plurality of isolation curtains positioned between consecutive pillars for providing air isolation between the two sides of the entry.

17. A method of removing coal from a face of an entry, the face exposing a roof, a floor, and two opposed ribs, comprising the steps of:

(a) sumping into the face to a first depth at a first lateral position with a dual action drum cutter having a first cutting drum mounted for rotation about a first axis and a second cutting drum mounted for rotation about a second axis, said first and second axes being in substantially parallel, spaced-apart relation and substantially perpendicular to the face, said first and second cutting drums also being adapted to cut into the face in a sumping direction substantially parallel to said first and second axes and in a shearing direction substantially transverse to said first and second axes;

(b) moving the dual action drum cutter to a second lateral position along a direction that is substantially parallel to the face and perpendicular to the two opposed ribs, the first and second drums cutting into and dislodging the coal along a lower pathway as the dual action drum cutter is moved to the second lateral position;

(c) elevating the first and second cutting drums to a raised position;

(d) sumping into the face to a second depth;

(e) returning the dual action drum cutter to the first lateral position, the first and second drums cutting into and dislodging the coal along an upper pathway as the dual action drum cutter is returned to the first lateral position;

(f) lowering the first and second cutting drums to a lowered position; and (g) repeating steps (a) through (f).

* * * * *